United States Patent [19]

Bouchard

[11] 4,351,065

[45] Sep. 28, 1982

[54] PROTECTIVE GARMENT FOR THE USER OF A CHAIN SAW

[75] Inventor: Edgar Bouchard, Mitassini, Canada

[73] Assignee: Normand Bouchard, Quebec, Canada

[21] Appl. No.: 237,948

[22] Filed: Feb. 25, 1981

[51] Int. Cl.[3] ..... A41D 13/00

[52] U.S. Cl. ..... 2/23

[58] Field of Search ..... 2/23, 22, 227, 231; 30/381-387

[56] References Cited

U.S. PATENT DOCUMENTS

| | | | |
|---|---|---|---|
| 1,654,452 | 12/1927 | Bradley | 2/227 |
| 1,801,437 | 4/1931 | Lown et al. | 2/22 |
| 3,191,185 | 6/1965 | Martin | 2/22 |
| 3,810,309 | 5/1974 | Wiklund et al. | 30/382 |
| 4,152,833 | 5/1979 | Phillips | 30/382 |

*Primary Examiner*—Doris L. Troutman

*Attorney, Agent, or Firm*—Cushman, Darby & Cushman

[57] ABSTRACT

The disclosure herein describes a protective garment for the user of a chain saw; the garment includes at least a portion forming pad consisting of a plurality of superposed layers of canvas sheets, at least one of which is loosely attached to the pad so that, when the chain of the saw accidentally touches the garment, the said loose layer is readily pulled off to jam and stop the rotation of the saw chain.

11 Claims, 4 Drawing Figures

PROTECTIVE GARMENT FOR THE USER OF A CHAIN SAW

FIELD OF THE INVENTION

The present invention concerns a protective or safety garment for the user of power chain saws whereby the chance of accident by the user is greatly reduced.

BACKGROUND OF THE INVENTION

Power chain saws are greatly utilized in the area of forestry for the removal of branches from trees; however, such use is considered to be one of the most dangerous forestry operations. Most users of power chain saws work in rapid short downward movements for small branches and, in some cases, will apply a downward force against the worked material to accelerate the sawing operation. In many of these cases, accidents will often occur when the downward movements of the saw, after having cut through the worked material, are not readily stopped resulting in the saw hitting the user in the knee area. Accidents, of course, often occur as a result of carelessness with an operating saw.

To reduce the accident rate, various protective means have been devised on the saws themselves. However, the speed with which the saw stops rotating is not sufficient to prevent some injury to the user. Garments have also been improved to protect the user; however, the improvements made to garments, up until now, only concern in thickening the user's garment thus rendering the wearing of such garments cumbersome.

OBJECTS AND STATEMENT OF THE INVENTION

It is an object of this invention to provide a garment especially designed to be used by the worker utilizing a power chain saw. This is achieved by providing, in a garment of the type described, a plurality of layers of canvas sheets, one of which will readily be pulled out as it is being seized by the saw chain and subsequently entrained to jam the operation of the saw.

The present invention therefore pertains to a garment for protecting the user of a power chain saw in which at least one section of the garment comprises: an outer layer of canvas material, a pad including a plurality of superposed layers of canvas material sewn together to the outer layer and at least one additional layer of canvas material which is loosely attached in the pad so that this additional layer may be readily pulled out when accidently seized and entrained by the chain of the saw, to subsequently jam and stop the operation of the saw chain.

In one particular form of the invention, this additional layer is interposed with the superposed layers and is stitched only along the upper and lower edges thereof. In another form of the invention, the layer is located between the outer layer and the group of superposed layers. Both alternatives are also possible together in one garment. The connection between the layer and the garment is done either by a loose stitching over a short distance or by means of elastic bands which permit some flexibility to the inner construction of the pad under the leg movements of the worker.

Other objects and scope of applicability of the present invention will become apparent from the detailed description given hereinafter; it should be understood however, that this description, while indicating preferred embodiments of the invention, is given by way of illustration only since various changes and modifications within the spirit and scope of the invention, will become apparent to those skilled in the art from reading the following description.

DESCRIPTION OF PREFERRED EMBODIMENTS

Figure 1:
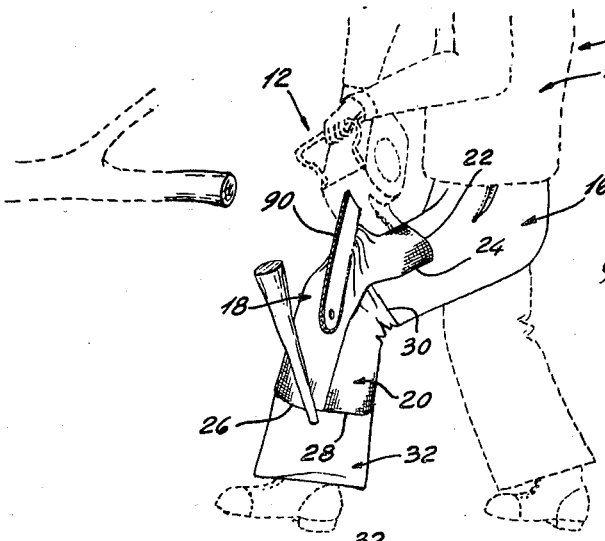
FIG. 1 shows in dotted lines the utilizer of a power chain saw accidentally contacting the knee portion of his garment, made in accordance with the present invention.

Referring to FIG. 1, the user 10, shown in dotted lines, of a power chain saw 12 is equipped with a protective garment, consisting of a jacket 14 and of trousers 16, made in accordance with the present invention. Although, the following description will be restricted to the construction of the trousers, it should be understood that the jacket may be equipped with a similar construction. Also, FIG. 1 shows that knee portion 18 and rear portion 20 are of a construction made in accordance with the present invention, these portions being areas where most accidents occur. However, it should be understood that the entire garment, jacket and trousers, can be constructed with the same structure as that described hereinbelow with respect to the knee portion 18.

Knee portion 18 and the rear portion 20 of each leg of the trousers are shown thicker as they comprise a pad of rectangular shape, stitched on all sides to the garment material. In the present embodiment, the pad is fixedly attached to the inner face of the garment layer 32, the latter thus becoming the outer covering the pad. The presence of such pad is determined only by the apparent stitched lines 22,24,25, 26 in the case of the knee portion 18 and stitched lines 24,25,28 and 30 in the case of the rear portion 20. Hence, the first layer in the construction of the protective garment is the outer layer 32 of the garment which may consist of any material which can be used for industrial jobs; it can be nylon, wool, polyester or light linen.

Figure 3:
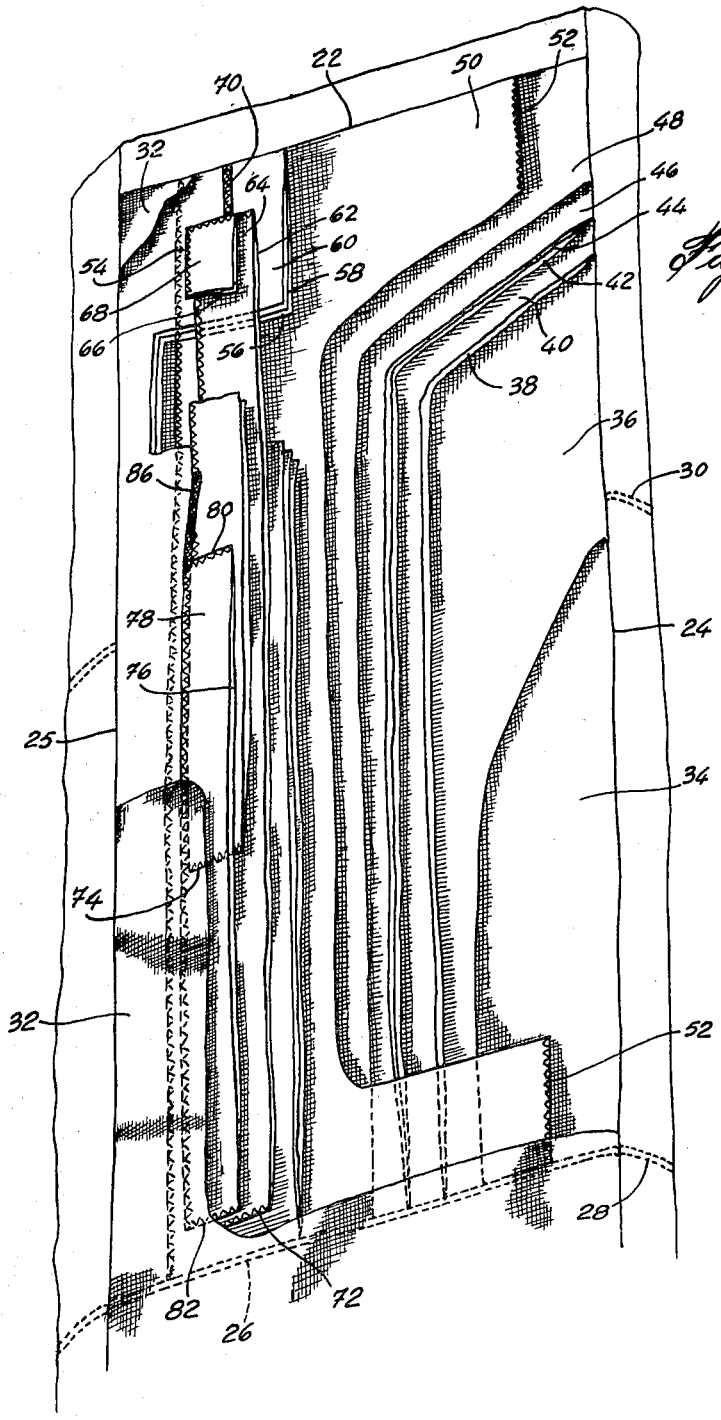
FIG. 3 is an enlarged perspective view of the various layers of canvas material making up the pad structure made in accordance with the present invention, sections of the layer being cut out for clarity purposes.

Referring to FIG. 3, the pad consists of an inner layer 34 extending between the horizontal stitched lines 22 and 26 and the vertical stitched lines 24 and 25. Also, sewn to the same stitched lines and extending over layer 34 are a ply 36 of material, such as silk or terylene, two plies 38 and 40 of resistant material, such as nylon 2108 denier, one ply 42 of silk or terylene, two plies 44 and 46 of nylon 2108 denier, one ply 48 of silk or terylene.

A band 50 of narrower width than that of the pad is secured only at the upper stitched line 22 and the lower stitched line 26; its vertical side edges 52 and 54 extend inwardly of the side lines 24 and 25 of the pad. Extending over the layer 50 is an arrangement of three plies 56,58 and 60 similar to the arrangement of plies 52,54 and 56, respectively, and secured to the pad along the stitched lines 22,24,26 and 25.

Extending over canvas sheet 60 is a staggered arrangement of detachable portions that include groups of plies of narrower width than that of layers 34,36,38,40,42,44,46 and 48. A first group consists of a ply 62 of silk or terylene and a ply 64 of nylon 2108 denier; a second group condists of a ply 66 of silk or terylene and a ply 68 of nylon 2108 denier. These detachable groups of plies 62,64 and 66,68 are secured to the garment by means of a pair of elastic bands 70 and 71, connected to the upper edge of the pairs to the stitched line 22 of the pad. As can be seen in FIG. 3, the group that includes plies 62 and 64 is longer than that which includes plies 66 and 68. The lower edge of the first group is shown at 72 whereas in the case of the second group, the lower edge is shown at 74. An additional group of plies extend over ply 68 and consists of a pair of plies 76 and 78 having the same width than that of the plies 62,64 and 66,68. The upper and lower edges of these plies are shown at 80 and 82, respectively. These plies are secured to ply 68 by means of a pair of plastic bands 86 and 87. Ply 76 may be of silk or terylene while ply 78 is a nylon 2108 denier.

When chain 90 of the saw accidentally contacts the knee portion of the garment, the elastic bands 70,71 and 86 and 87 holding the detachable portions to the pad will ripped off quickly entraining the portions which will jam and choke the chain saw. Thus, the chain will not penetrate to the worker's leg.

The provision of the band 50 which is not stitched along its vertical sides to the pad will also cause a certain delay in the penetrating action of the chain since it is not fixedly secured and will cause the chain to slip thereover prior to engaging the other succeeding attached plies.

Figure 2:
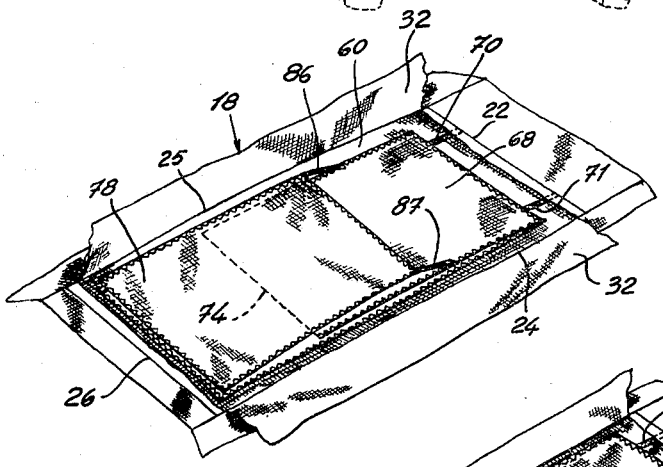
FIG. 2 shows the knee portion of the garment of FIG. 1 with the outer layer being removed to show the loosely attached portions of the pad.
Figure 4:
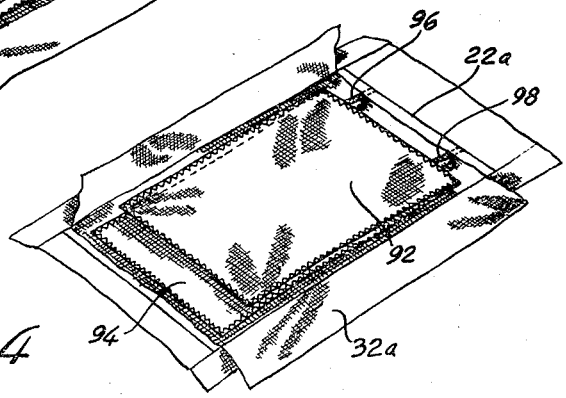
FIG. 4 is a view similar to FIG. 2, showing any form of attaching the detachable layers to the pad, this figure being shown on the same sheet illustrating FIGS. 1 and 2.

FIG. 4 shows another embodiment of the present invention where the detachable portions of the pad consist of two groups of plies 92 and 94 which are connected to the stitched line **22*a* by means of a pair of elastic bands 96 and 98. The groups are located immediately underneath the outer layer 32*a* of the garment and may consist of pair of plies (silk or terylene with nylon 2108 denier), the other layer located therebeneath being of similar construction to that shown in FIGS. 2 and 3**. Hence, a detailed construction of these layers is not considered necessary.

It will be evident to the man skilled in the art that modifications can be brought to the present construction. For example, elastic bands could also be provided to secure the lower edges of the detachable portions so as to limit lateral movement of these portions within the pad. Also, instead of using elastic bands, a loose stitch may be provided to secure the detachable portions to the remainder of the pad.

The embodiments of the invention in which an exclusive property or privilege is claimed are defined as follows:

1. A garment for protecting the user of a chain saw wherein at least one section of the garment comprises: an outer layer of canvas material; a pad including a plurality of superposed plies of canvas material sewn together to said outer layer, and at least one additional layer of canvas material loosely attached in said pad so that said additional layer may be readily pulled out when seized accidently and entrained by the chain of the saw, to subsequently jam and stop the operation of the saw chain.

2. A garment as defined in claim 1, wherein said additional layer of canvas material is disposed between said outer layer and said plurality of superposed plies of canvas material.

3. A garment as defined in claim 2, wherein said additional layer of canvas material consists of a series of canvas sheets loosely connected to one another and to the outer layer and disposed in staggered arrangement relative to one another.

4. A garment as defined in claim 1, wherein said additional layer is attached by means of elastic bands having sufficient strength to hold said additional layer when said garment is used but which will easily break under the pulling action of the saw chain.

5. A garment as defined in claim 1, wherein said additional layer is attached by loose stitching.

6. A garment as defined in claim 1, wherein said additional layer of canvas material is interposed within said plurality of superposed plies of canvas material and is sewn to the pad only at the upper and lower edges thereof.

7. A garment as defined in claim 6, wherein said interposed layer is of the same material as that of said outer layer.

8. A garment as defined in claim 1, wherein said additional layer has a width narrower than that of said superposed plies of canvas material.

9. A garment as defined in claim 8, wherein said additional layer is stitched at its upper and lower edges to the upper and lower edges of said superposed plies.

10. A garment as defined in claim 1, wherein said superposed layers consist of sheets of rectangular shape, being stitched on all sides to said outer layer.

11. A garment as defined in claim 1, wherein said superposed layers consist of alternate layers of a material selected from the group including silk, terylene and of a material made of nylon 2108 denier.

* * * * *